US006840403B2

(12) United States Patent
Girouard

(10) Patent No.: US 6,840,403 B2
(45) Date of Patent: Jan. 11, 2005

(54) HOT GLUE AND CRAYON MULTI-FUNCTIONAL ART MEDIUM AND METHOD

(76) Inventor: John A. Girouard, 2 Cassie Cove RD, Center Ossipee, NH (US) 03814

( * ) Notice: Subject to any disclaimer, the term of this patent is extended or adjusted under 35 U.S.C. 154(b) by 231 days.

(21) Appl. No.: 10/316,501

(22) Filed: Dec. 10, 2002

(65) Prior Publication Data

US 2004/0108335 A1 Jun. 10, 2004

(51) Int. Cl.[7] ..... B67D 5/62
(52) U.S. Cl. ..... 222/1; 222/146.5
(58) Field of Search ..... 222/1, 146.5

(56) References Cited

U.S. PATENT DOCUMENTS 4,813,062 A * 3/1989 Gilpatrick ..... 378/162
2002/0006604 A1 * 1/2002 Schwabacher ..... 435/4
2004/0108335 A1 * 6/2004 Girouard ..... 222/146.5

OTHER PUBLICATIONS

Thoughtfulness Can Create Some Great Holiday Gifts□□Hannah Lee, Apopka Hihg. Orlando Sentinal. Orlando, Fla.; Dec. 8, 2000. p. Y.2. (FRAMES).*

Re: Moe Glue Eggs??□□In Reply to : Moe Glue Eggs?? posted by Jay on Mar. 3, 2000 at 12:38:25□□http://www.i–depth.com/P/u/ue07299.frm.FlyTying.msg/50.html (Web page).*

The Flyfishing Forum, –The Quintessential Trout, –Glue gun eggs. □□Domenic Mar.12, 2002 03:36 AM□□http://www.flyfishingforum.com/flytalk4/printthread.php?s=&threadid=5447 (Web page).*

Hot Glue—Product Review□□Author: Tyra Smith, Product Review Copyright 2002□□http://netnet.net/~cloud9/pr_hot_glue.html (Web page).*

* cited by examiner

*Primary Examiner*—Kenneth Bomberg

(57) ABSTRACT

Alternating pieces of hot glue and crayon are inserted into a hot glue gun and melted together to form a multi-functional art material or medium. It can be used as a paint on canvas and other paint receptive surfaces, as a ready-made collage medium with adhesive properties as well as color, as a medium for sculpture, relief, and other three-dimensional art forms, as a clay substitute medium for pottery and other related crafts as well as an aesthetic or invisible (color-matching) repair medium.

6 Claims, 2 Drawing Sheets

HOT GLUE AND CRAYON MULTI-FUNCTIONAL ART MEDIUM AND METHOD

BACKGROUND OF THE INVENTION

1. Field of the Invention

The present invention relates to art materials and in particular to a multi-functional art material fabricated from hot glue and crayon for use as a paint on canvas and other paint receptive surfaces, as a ready-made collage medium with adhesive properties as well as color, as a medium for sculpture, relief, and other three-dimensional art forms, as a clay substitute medium for pottery and other related crafts as well as an aesthetic or invisible (color-matching) repair medium.

2. Description of the Prior Art

Art materials are normally specific to one medium, such as oil, acrylic and water color paint for paintings, and clay for three-dimensional sculpture and pottery. While each medium works well for its intended use there is usually an inflexibility in attempting to use one of the standard art mediums for mixed media works of art and many of the varied types of experimental works being explored by artists.

There have been prior art patents related to art and craft media involving heating and to creating colored glue crayons and various other somewhat related materials and methods, but none actually combine hot glue and crayons to make an art medium.

U.S. patent application No. 2002/0130122 filed Sep. 19, 2002 by Berger, and U.S. Pat. No. 6,459,073 issued Oct. 1, 2002 illustrate an improved arts and crafts hot pot. The arts and crafts hot pot is used to melt various types of materials such as thermographic resins, crayons, glue etc. The materials are used in the fabrications of various craft items. He does not talk about melting the crayons and glue together at the same time.

U.S. Pat. No. 3,385,954 issued May 28, 1968 to Rabinowitz et al, discloses an electrically heated wax melting tool for encaustic painting. This tool for melting wax for batik and encaustic painting has a palette with removable wax melting cups combined with a wax dispensing pen. The palette and pen are heated by a single heating element. Wax of various colors is melted in the cups for application by brush or swab stick. Wax is also melted in the pen and dispensed through a valved spout in a smooth even line. A modified version of the tool includes only the palette portion. The heating element in both versions comprises a conventional electric soldering iron, the handle of which is used to manipulate the wax melting tool. He talks about melting crayons, but not with glue.

U.S. Pat. No. 4,279,674, issued Jul. 21, 1981 to Wadden, claims a new and improved process for preparing works of art. This process for preparing a work of art includes steps of melting crayon, transferring that molten crayon to a backing member to form a background and forming a design on that background. The design is formed using a hand-held heating element to melt portions of the background and/or to transfer further molten crayon to the background. A kit containing crayons and backing members is also disclosed. She melts the crayons and uses glue in the art process, but not mixed or melted with the crayons.

U.S. Pat. No. 4,584,042 issued Apr. 22, 1986 to Wandroik, describes an artistic method for creating an art form including the step of permanently affixing a first substrate material to a second substrate material wherein the second substrate material is rigid relative to the first substrate material. A heat-activated transitional material is then softened with a flame and applied to an upper surface of the first substrate material wherein the transitional material has a predetermined color and is applied to the upper surface of the first substrate material with varying amounts of pressure so that the softened transitional material adheres to the upper surface of the first substrate material and solidifies thereon to a predetermined thickness and has a desired predetermined texture. The artistic method for creating an art form can further include the step of coating the solidified transitional material on the upper surface of the first substrate material with a protective material. A kit is provided for carrying out the method and includes substrate materials, crayons, and a candle. The method includes melting crayons. Glue is provided in the kit but only for gluing the paper to the board.

U.S. Pat. No. 6,165,406 issued Dec. 26, 2000 to Jang et al, indicates a freeform fabrication process and apparatus for making a colorful 3-D object. The process includes (1) operating a multiple-channel droplet deposition device for supplying and, on demand, ejecting droplets of multiple liquid compositions containing a solidifiable baseline body-building material and different colorants; (2) providing a support platform a distance from this deposition device to receive the droplets therefrom; and (3) during the droplet ejecting process, moving the deposition device and the platform relative to one another in an X-Y plane and in a Z direction orthogonal to the X-Y plane so that the droplets are deposited to form multiple layers to build a colorful 3-D object. These steps are executed under the control of a computer system by taking additional steps of (4) creating a geometry and color pattern of the object on a computer with the geometry including a plurality of color-coded segments defining the object; (5) generating programmed signals corresponding to each of the segments in a predetermined sequence; and (6) moving the deposition device and the platform relative to each other in response to these programmed signals. Preferably, the system is also operated to generate a support structure for any un-supported feature of the object. This patent mentions using a hot glue melt with a colorant, but does not mention crayons.

U.S. Pat. No. 6,136,119, issued Oct. 24, 2000 to Columbus, describes a method for adhering two surfaces by use of a polyisobutylene adhesive crayon. This invention relates to thermoplastic, pressure-sensitive solid adhesives capable of transferring an adhesive film to a substrate by friction rubbing of the adhesive on the substrate. The adhesives of this invention consist essentially of polyisobutylene, wax and optionally an adhesive promoter resin. Said ingredients are within certain proportions, molecular weights, melting points, or hardness values. This patent actually describes making a glue crayon by combining wax and a colorant and a glue base and melting them together and then cooling them in forms to create the glue crayons, but they are used like regular crayons on paper, so they do not use the hot soft material to make art and they do not combine ready-made crayons with hot glue.

U.S. Pat. No. 5,604,268, issued Jan. 18, 1997 to Randen, shows glue crayons comprising acrylate polymers, tackified acrylate polymers, acrylate polymers containing specific, pendent, macromeric units, acrylate polymers containing high chain length alkyl (meth)acrylate monomers, acrylate polymers containing both macromeric and high chain length alkyl groups and acrylate polymers containing crystalline additives and includes (a) an acrylate-based adhesive polymer, (b) a tackifier; (c) a crystalline additive; and (d) at leastone filler. Again these are basically colored glue sticks and they do not combine existing crayons with hot glue.

None of the prior art patents produce the desired results. What is needed is a versatile multi-functional art medium.

SUMMARY OF THE INVENTION

An object of the present invention is to provide a versatile multi-functional art medium fabricated from adhesive malleable hot glue and colored waxy crayons.

Another object of the present invention method of making an art medium with adhesive properties and rich wax based color.

One more object of the present invention is to provide highly workable malleable three-dimensional medium.

An additional object of the present invention is to create a colored adhesive material for sticking on other materials to produce collages.

A further object of the present invention is to provide a highly adhesive thick paint material built up higher on canvas than other paint materials.

A contributory object of the present invention is a highly flexible colored art material vary color intensity by ratio of glue to crayon.

An added object of the present invention is that it is easy and inexpensive to make with a glue gun.

Yet another object of the present invention is a very workable, malleable art material that sticks well and it dries hard by itself without further processing.

In brief, hot glue and crayons are combined to create a new multifunctional art medium (STAINED PLASTIC). The process begins by stripping the paper off the crayon, breaking or cutting it into pieces and cutting the glue stick into pieces. The pieces are then alternately inserted into a hot glue gun, starting with the crayon then the glue, adding more glue where crayon is thickest and mix together. The art medium created by heating together glue sticks and crayon can be put on canvas, used to build sculptures or vessels, used to better conceal glue in crafts, or applied as colored repair material.

An advantage of the present invention is the ability to create a three-dimensional piece of art.

Another advantage of the present invention is to produce a new art medium by using common materials, hot glue and crayons.

An additional advantage of the present invention is that it is highly malleable and workable.

One more advantage of the present invention is its being multifunctional, for many uses including; applying thickly on canvas, to build sculptures or vessels, or to produce collages.

An advantage to this invention is the ability to control the degree of intensity of color by simply varying the ratio of hot glue to crayon.

Yet another advantage of this invention is providing an art medium with adhesive properties and rich wax based colors.

Another advantage being the invention's ability to be a very workable, malleable art material that sticks well and it dries hard by itself without further processing.

One more advantage is the invention being inexpensive to create.

The last advantage being able to use this invention to conceal repairs by matching colors exactly to the item needing repair.

BRIEF DESCRIPTION OF THE DRAWINGS

These and other details of my invention will be described in connection with the accompanying drawings, which are furnished only by way of illustration and not in limitation of the invention, and in which drawings.

BEST MODE FOR CARRYING OUT THE INVENTION

Figure 1:
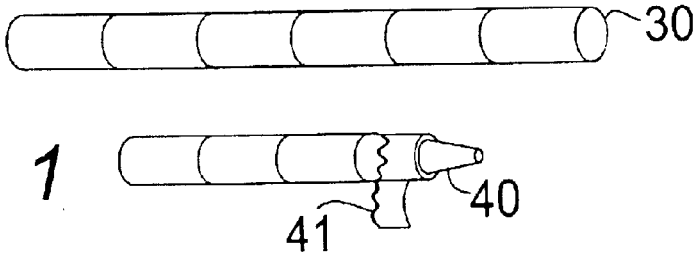
FIG. 1 is a perspective view of a stick of hot glue and a stick of crayon with lines indicating where each might be broken or cut up.
Figure 2:
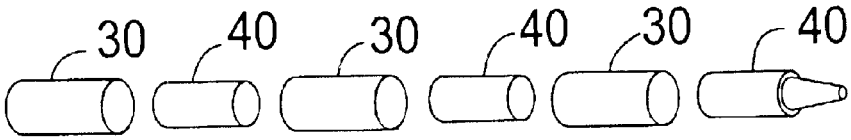
FIG. 2 is a perspective view of the alternate pieces of the hot glue and the crayon aligned to be inserted in a glue gun.
Figure 3:
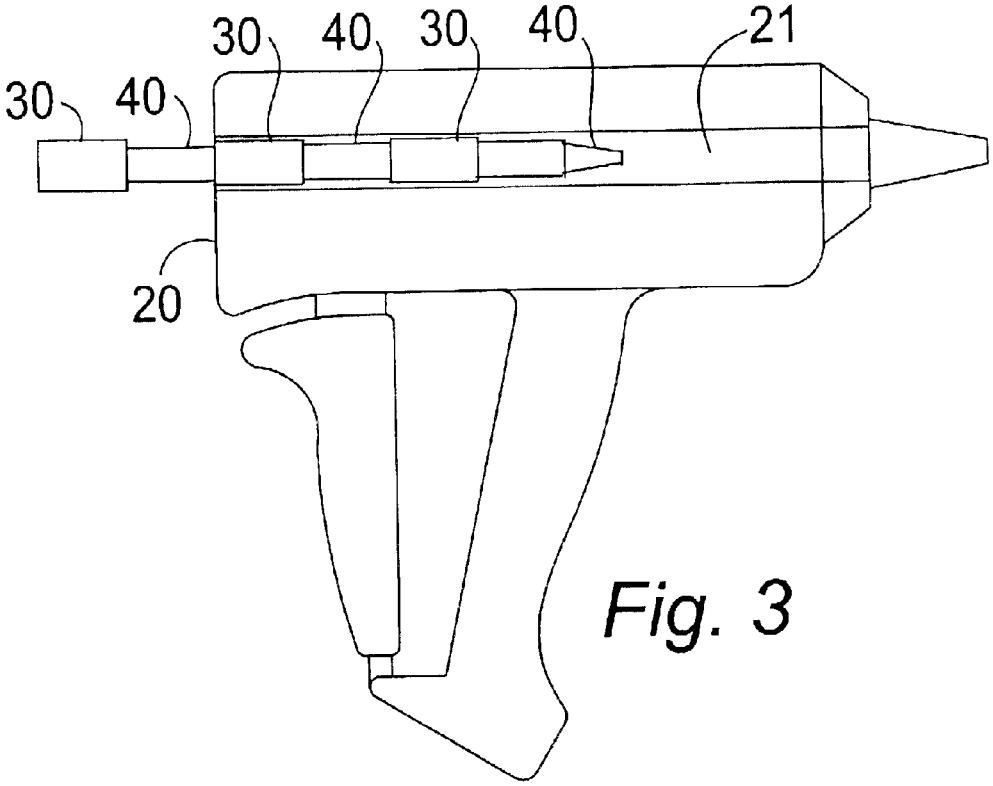
FIG. 3 is a side elevational view in partial section showing the insertion of the alternating pieces of hot glue and crayon being inserted in a hot glue gun.

In FIGS. 1–7, a multifunctional art medium 50 comprises a combination of pieces of hot glue 30 and pieces of crayon 40 melted together in a container means which is preferably a hot glue gun 20. The hot glue gun 20 is used for mixing the pieces of hot glue 30 and the pieces of crayon 40 by heating up the mixture in the heating chamber 21 of the glue gun 20 to melt together and combine the hot glue 30 and the crayon 40 into a multi-functional art medium 50 which can be used in paintings and collages as in FIGS. 4 and 5, in sculptures as in FIG. 6, and pottery as in FIG. 7 as well as many other uses such as a matching color repair medium.

In practice, the method of making a multifunctional art medium 50 comprises a first step of peeling the paper 41 off of the crayons 40, and then cutting the crayons 40 and the hot glue 30 into the desired smaller pieces. The next step comprises loading the hot glue gun 20, by inserting, alternately, first the crayon 40 and then the hot glue 30 into the heating chamber 21 of the hot glue gun 20. It would be necessary to add more hot glue 30 where the crayon 40 is thickest. The color intensity can be varied by adjusting the amount of hot glue 30 relative to the amount of crayon 40. The next step comprises heating the the crayon 40 and the hot glue 30 until they reach a melting stage and melt together to form the multifunctional art medium 50.

The multifunctional art medium 50 is capable of many applications including paintings, collage, sculpture, relief, pottery, colored repairs, and any combination thereof.

Figure 4:
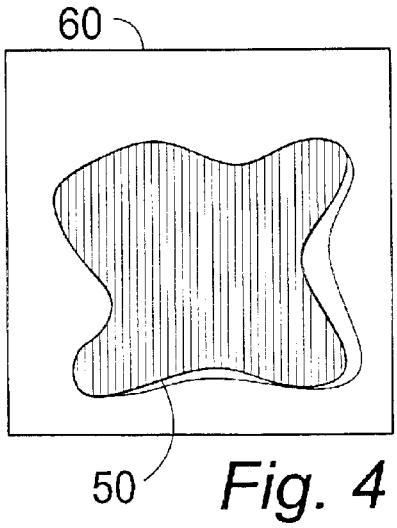
FIG. 4 is a front elevational view of a canvas with the multi-functional art medium of the present invention produced by hot glue and crayon applied to the canvas as a painting.

In FIG. 4 the art medium 50 is applied to any desired thickness, shape, color, style, and various other artistic variables to a canvas 60 to create a painting.

Figure 5:
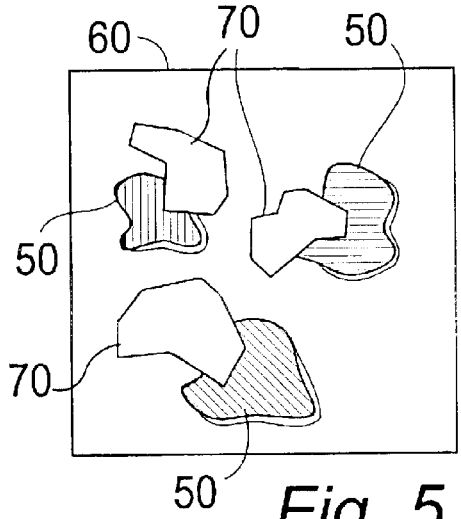
FIG. 5 is a front elevational view of a canvas with the multi-functional art medium of the present invention produced by hot glue and crayon applied to the canvas as a collage with pieces of material attached to the art medium.

In FIG. 5 the art medium 50 is applied to any desired thickness, shape, color, style, and various other artistic variables to a canvas 60 and then other materials 70 are stuck onto the adhesive art medium 50 to create a collage.

Figure 6:
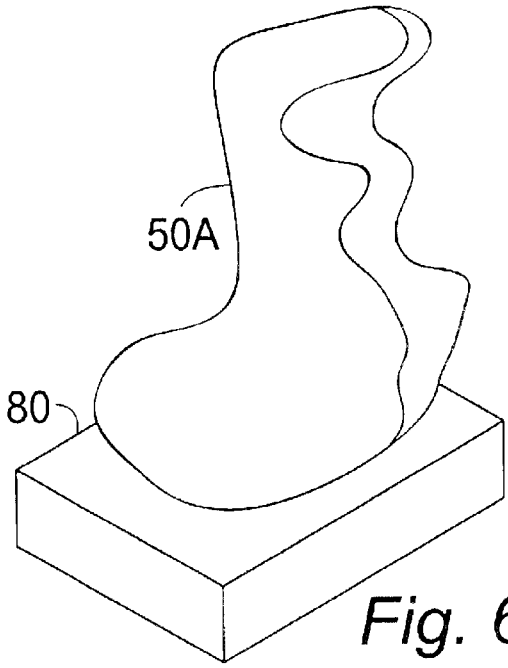
FIG. 6 is a perspective view of a pedestal and sculpture created using the multi-functional art medium of the present invention produced by hot glue and crayon.

In FIG. 6 the art medium 50A is applied in a shaped three dimensional mass to form a sculpture which is shown resting on a pedestal 80.

Figure 7:
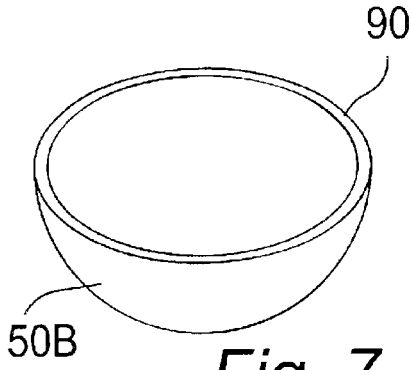
FIG. 7 is a perspective view of a bowl created using the multi-functional art medium of the present invention produced by hot glue and crayon.

In FIG. 7 the art medium 50B is applied in a worked to form a piece of pottery in the shape of a bowl 90.

The multi-functional art medium 50 has the desirable qualities of broad variations of colors and intensity, easy workability to form in shapes of any desired thickness or mass, adhesiveness, malleability, a warmth for comfortable handling, a self-solidifying capability, and many other versatile qualities to enable a broad spectrum of uses.

It is understood that the preceding description is given merely by way of illustration and not in limitation of the invention and that various modifications may be made thereto without departing from the spirit of the invention as claimed.

What is claimed is:

1. A multi-functional art medium comprising:

a quantity of hot glue;

at least one crayon;

a container means for mixing the quantity of hot glue and the at least one crayon and for heating up the mixture to combine the hot glue and the crayon into a multi-functional art medium.

2. The multi-functional art medium of claim 1 wherein the container means comprises a hot glue gun.

3. The multi-functional art medium of claim 1 wherein the multi-functional art medium is capable of being used for paintings, collage, sculpture, relief, pottery, colored repairs, and any combination thereof.

4. A method of making a multi-functional art medium comprising:

a first step of combining a quantity of hot glue with at least one crayon;

a second step of heating and mixing the quantity of hot glue and the at least one crayon in a container means for mixing the quantity of hot glue and the at least one crayon and for heating up the mixture to combine the hot glue and the crayon into a multi-functional art medium.

5. The method of claim 4 wherein the container means comprises a hot glue gun and the first step comprises loading the hot glue gun by alternately placing a portion of the quantity of hot glue and a portion of the at least one crayon into the hot glue gun and the second step comprises turning on the hot glue gun and attaining a degree of heat in which both the hot glue and the crayon will both melt.

6. The method of claim 4 further comprising the step of applying the multi-functional art medium for paintings, collage, sculpture, relief, pottery, colored repairs, and any combination thereof.

* * * * *